US008371880B2

(12) United States Patent
Ishimaru

(10) Patent No.: US 8,371,880 B2
(45) Date of Patent: Feb. 12, 2013

(54) ELECTRICAL CONNECTOR HAVING A BOARD CONNECTION LEG PORTION WITH A LOCKING PORTION TO ENGAGE A SIGNAL TRANSMISSION MEDIUM AND A CONNECTOR MAIN BODY WITH AN UNLOCKING PORTION

(75) Inventor: Masao Ishimaru, Machida (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 0 days.

(21) Appl. No.: 13/242,201

(22) Filed: Sep. 23, 2011

(65) Prior Publication Data

US 2012/0100742 A1 Apr. 26, 2012

(30) Foreign Application Priority Data

Oct. 12, 2010 (JP) ..... 2010-229298

(51) Int. Cl.
*H01R 13/62* (2006.01)

(52) U.S. Cl. ..... 439/632

(58) Field of Classification Search ..... 439/326, 439/157–160

See application file for complete search history.

(56) References Cited

U.S. PATENT DOCUMENTS 4,986,765 A * 1/1991 Korsunsky et al. ..... 439/326
5,267,872 A * 12/1993 Gou et al. ..... 439/326
5,286,217 A * 2/1994 Liu et al. ..... 439/326
5,372,518 A * 12/1994 Liu et al. ..... 439/326
5,470,240 A * 11/1995 Suzuki ..... 439/157
6,379,168 B1 * 4/2002 Wang ..... 439/160
7,938,657 B2 * 5/2011 Tang et al. ..... 439/160

FOREIGN PATENT DOCUMENTS

JP 2001-196130 7/2001
JP 2003-100370 4/2003
JP 2011-40246 2/2011

OTHER PUBLICATIONS

U.S. Appl. No. 29/397,662, filed Jul. 19, 2011, Ishimaru.
U.S. Appl. No. 13/198,014, filed Aug. 4, 2011, Ishimaru.
U.S. Appl. No. 13/495,479, filed Jun. 13, 2012, Ishimaru.

* cited by examiner

*Primary Examiner* — Chandrika Prasad
(74) *Attorney, Agent, or Firm* — Oblon, Spivak, McClelland, Maier & Neustadt, L.L.P.

(57) ABSTRACT

A signal transmission medium inserted in a connector main body portion, which can be held and released successfully with a simple configuration, is disclosed. A distal end portion of an elastically-displaceable cantilever-shaped locking arm member formed so as to be integral with a board connection leg portion (holddown) is provided with a locking portion engaged with a portion of the signal transmission medium inserted in the connector main body portion to hold the inserted state. The held state of the signal transmission medium is maintained by elastic action of the locking arm member extending in a relatively-elongated shape from a swinging fulcrum. Simultaneously, an unlocking-action force on the locking portion can be reduced, and an unlocking-operation force is stably received by the board connection leg portion (holddown) fixed to a printed circuit board so that improvement in strength is achieved.

7 Claims, 9 Drawing Sheets

ELECTRICAL CONNECTOR HAVING A BOARD CONNECTION LEG PORTION WITH A LOCKING PORTION TO ENGAGE A SIGNAL TRANSMISSION MEDIUM AND A CONNECTOR MAIN BODY WITH AN UNLOCKING PORTION

BACKGROUND OF THE INVENTION

1. Field of the Invention

The present invention relates to an electrical connector configured to hold a signal transmission medium inserted in a connector main body portion with a lock portion.

2. Description of the Related Art

Conventionally, various electrical devices or the like adopt an electrical connector that connects a signal transmission medium, such as a flexible flat cable (FFC) or a flexible printed circuit board (FPC), electrically to a circuit board. This electrical connector is mounted such that a connector main body portion rises from a surface of the circuit board, for example, via a board connecting leg portion (holddown) joined to the circuit board, and configured to achieve electrical connection by inward insertion of a signal transmission medium through an insertion opening portion provided in the connector main body portion of the electrical connector.

In a terminal portion in an insertion side of the signal transmission medium inserted into such an electrical connector, a positioning portion composed of a recess, for example, in a notch shape is formed, and a locking member provided in the electrical connector is engaged with the positioning portion provided in the signal transmission medium so that an inserted state of the signal transmission medium is held.

However, a conventional electrical connector of this type described in JP-A-2001-196130 (the term "JP-A" as used herein means an "unexamined published Japanese patent application") does not use a slider for obtaining contact pressure between a contact group held in the connector and respective lands of an FPC, but has a locking lever pivotally attached to prevent the FPC from dropping off even with a small contact load. In this case, since a locking portion provided in the connector main body portion is a separately-formed member, there is a tendency for the connector to become expensive as a whole due to increase in the number of parts. Further, since the locking portion is configured to engage the signal transmission medium by its own weight, there is the problem that a holding force to the signal transmission medium cannot sufficiently be obtained. Furthermore, another conventional connector described in JP-A-2003-100370 can prevent positional deviation or the like of the FPC since elastically-supporting pieces that support the FPC by elastically pressing are provided on reinforcing brackets attached to both ends of a housing of the connector and soldered on a circuit board. However, since a direction in which the elastically-supporting piece applies a pressing force and a soldered portion of the reinforcing bracket are in a relationship of positional deviation, there is such a possibility that according to a repetitive unlocking operation of a locking portion, an unlocking-operation force continuously applied to a connector main body portion affects a mounted state or the like of the connector main body portion, which results in lack of stability in electrical connection.

SUMMARY OF THE INVENTION

Therefore, an object of the present invention is to provide an electrical connector with a simple configuration that makes it possible to successfully hold and release the signal transmission medium inserted in the connector main body portion.

In order to achieve the above object, the electrical connector according to the present invention is an electrical connector configured such that a connector main portion is mounted so as to rise from a surface of a circuit board via board connection leg portions joined to the circuit board, a signal transmission medium is inserted into the connector main body from an insertion opening portion provided on an end portion of the connector main body positioned on the rising side thereof, and a locking portion is caused to engage a portion of the signal transmission medium inserted into the connector main body to hold the inserted state of the signal transmission medium so that the signal transmission medium is electrically connected to the circuit board, adopting such a configuration where the locking portion is provided on a portion of an elastically-displaceable locking arm member formed so as to be integral with the board connection leg portion; the locking arm member is formed of a swinging member extending in a cantilever shape from the board connection leg portion toward the insertion opening portion; and the locking portion is disposed at a distal end portion of the locking arm member positioned on a swinging side thereof.

According to such a configuration, the holding state of the signal transmission medium by the locking portion is well maintained by an elastic action of the locking arm member composed of the swinging member, while the locking arm member extends from the board connection leg portion (holddown) which is a swinging fulcrum up to the locking portion on the swinging side to have a relatively-elongated swinging radius so that an unlocking operation to the locking portion holding the signal transmission medium can be performed with a relatively small operating force.

Further, since an unlocking-operation force applied to the locking member is stably received by the board connection leg portion (holddown) fixed to a printed circuit board via the locking arm member, strength the locking portion to an unlocking operation is improved, so that even if unlocking operation of the locking portion is repeatedly performed many times, the effect to the mounting state of the connector main body or the like is reduced, so that electrical connection state is stably maintained for a long period.

Furthermore, since the locking arm member having the locking portion is formed to be integral with the board connection leg portion (holddown), the locking portion as well as the board connection leg portion is manufactured efficiently.

In addition, when the signal transmission medium is inserted into the insertion opening portion of the connector main portion, the positional relationship between the insertion opening portion of the connector main body and the signal transmission medium can be easily observed from above, so that an insertion operation of the signal transmission medium can be performed easily and accurately, and the state of the signal transmission medium after inserted can be well secured.

Further, in this invention, it is desirable that the connector main body portion is provided with an unlocking portion that releases the locking portion from the signal transmission medium, the unlocking portion is provided on a portion of an unlocking arm member formed of a swinging member extending in a cantilever shape so as to be elastically displaceable, and the unlocking portion is disposed so as to abut on or separate from a distal portion of a swinging portion of the locking arm member, which is positioned near the locking portion, according to swinging of the unlocking arm member.

According to such a configuration, when the unlocking operation for releasing the locking portion from the signal transmission medium is performed, the distal portion of the swinging portion of the locking arm member is pressed by the unlocking portion, so that an action force required for the unlocking operation is reduced and an easy unlocking operation is made possible.

It is desirable that the unlocking arm member in this invention is formed so as to be integral with an insulating housing constituting the connector main body portion.

According to such a configuration, since the unlocking arm member and the unlocking portion are formed simultaneously with formation of the insulating housing, reduction in manufacturing cost can be achieved effectively by suppressing increase of the number of parts.

Further, in this invention, it is desirable that the board connection leg portions (holddown) are provided in pair so as to protrude in an extending direction of the swinging radius of the locking arm member and in the opposite directions from each other from the connector main body portion.

According to such a configuration, when an operation force is applied to the unlocking arm member to swing the locking portion in order to release the locking portion from the signal transmission medium, a swinging-operation force to the unlocking arm member is received directly by the pair of board connection leg portions (holddown), and deformation or the like of the connector main body is prevented so that the connection state of the signal transmission medium is well maintained.

Further, it is desirable that the insulating housing in this invention is provided with a locking-movement restricting portion that defines a maximum movable position of the locking portion by abutting on the locking portion caused to release from the signal transmission medium.

According to such a configuration, when an operation force is applied to the unlocking arm member to swing the locking portion in order to release the locking portion from the signal transmission medium, a movement amount of the locking portion is restricted so as not to become excessive, so that deformation, damage or the like of each portion can be avoided.

Further, in this invention, it is desirable that a swinging radius L2 of the unlocking arm member is set larger than a swinging radius L3 of the locking arm member (L2>L3). Furthermore, it is desirable that the unlocking arm member is provided with an unlocking-operation portion that swings the unlocking arm member, and the unlocking-operation portion is disposed outside the unlocking portion in a swinging radius direction.

According to such a configuration, when an operation force is applied to the unlocking arm member to swing the locking portion in order to release the locking portion from the signal transmission medium, an application force required for the unlocking arm member becomes smaller than a movement force of the locking portion, so that an operation force required for unlocking is reduced and an unlocking operation is easily performed.

Further, it is desirable that the insulating housing is provided with an unlocking-operation restricting portion that defines a maximum movable position of the unlocking-operation portion by abutting on the unlocking-operation portion.

According to such a configuration, when an operation force is applied to the unlocking arm operation portion to swing the locking portion in order to release the locking portion from the signal transmission medium, a movement amount of the unlocking-operation portion is restricted so as not to become excessive, so that deformation, damage or the like of each portion can be avoided.

EFFECT OF THE INVENTION

As described above, since the electrical connector according to this invention is configured such that the locking portion engaging a portion of the signal transmission medium inserted into the connector main body to hold the inserted state is provided at a distal end portion of the elastically-deformable cantilever-shaped locking arm member formed integrally with the board connection leg portions (holddown), the holding state of the signal transmission medium is well maintained by an elastic action of the locking arm member extending in a relatively-elongated shape from the board connection leg portion (holddown) which is a swinging fulcrum while an unlocking-operation force to the locking portion holding the signal transmission medium is reduced, strength improvement is achieved by receiving an unlocking-operation force stably from the board connection leg portion (holddown) fixed to a printed circuit board via the locking arm member, and an electrical connection state is stably maintained at low cost and for a long period, holding and releasing of the signal transmission medium inserted into the connector main body can be well achieved with a simple configuration, and reliability of the electrical connector can be considerably improved at a low cost.

DETAILED DESCRIPTION OF THE INVENTION

Figure 1:
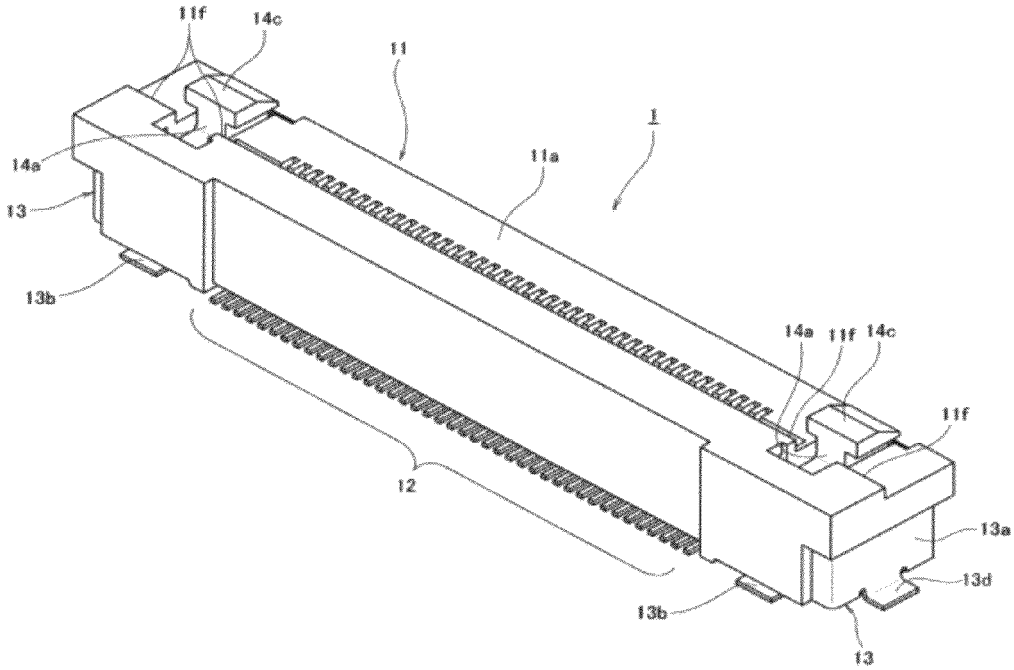
FIG. 1 is a perspective appearance explanatory view showing a structure of an electric connector according to an embodiment of the present invention.
Figure 2:
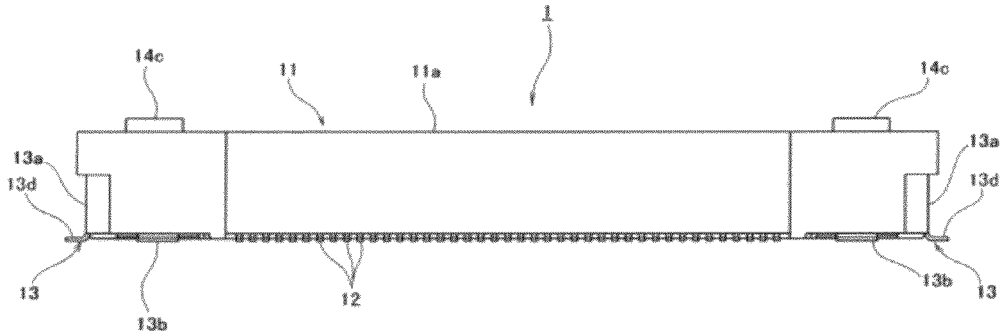
FIG. 2 is a back explanatory view of the electrical connector shown in FIG. 1.
Figure 3:
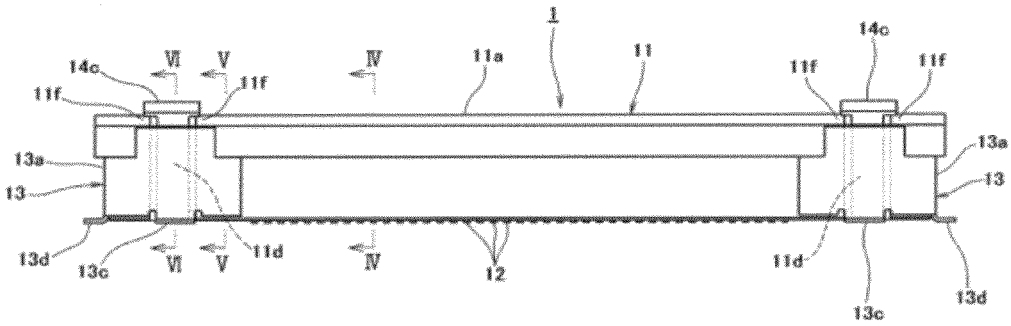
FIG. 3 is a front explanatory view of the electrical connector shown in FIG. 1.
Figure 4:
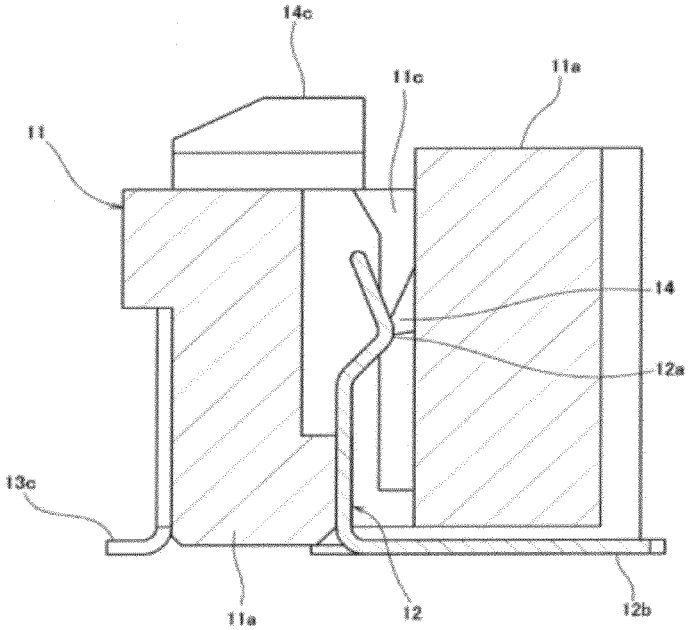
FIG. 4 is a cross-sectional explanatory view taken along line IV-IV in FIG. 3.
Figure 5:
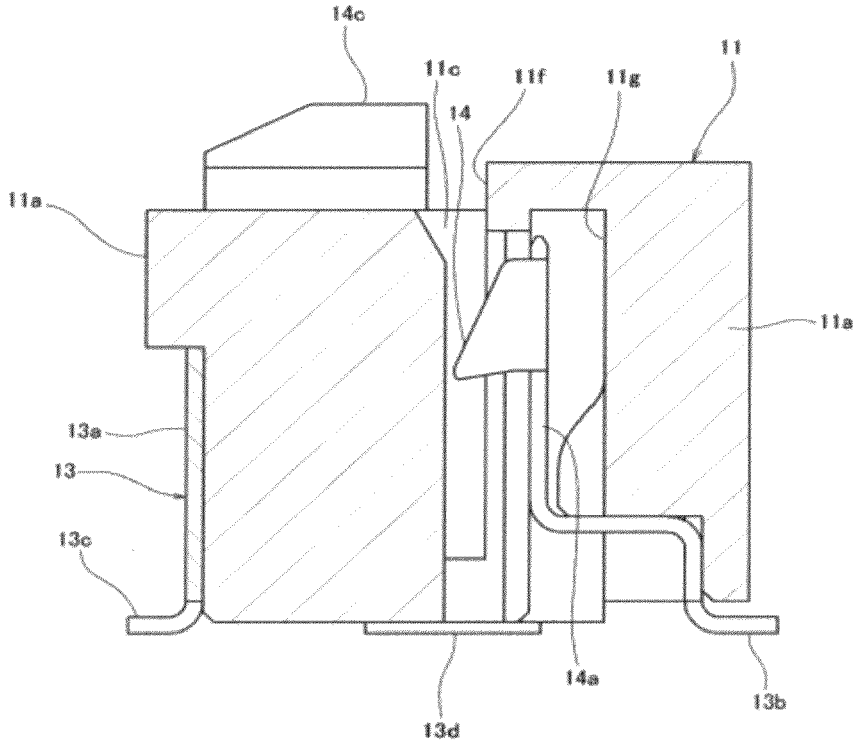
FIG. 5 is a cross-sectional explanatory view taken along line V-V in FIG. 3.
Figure 6:
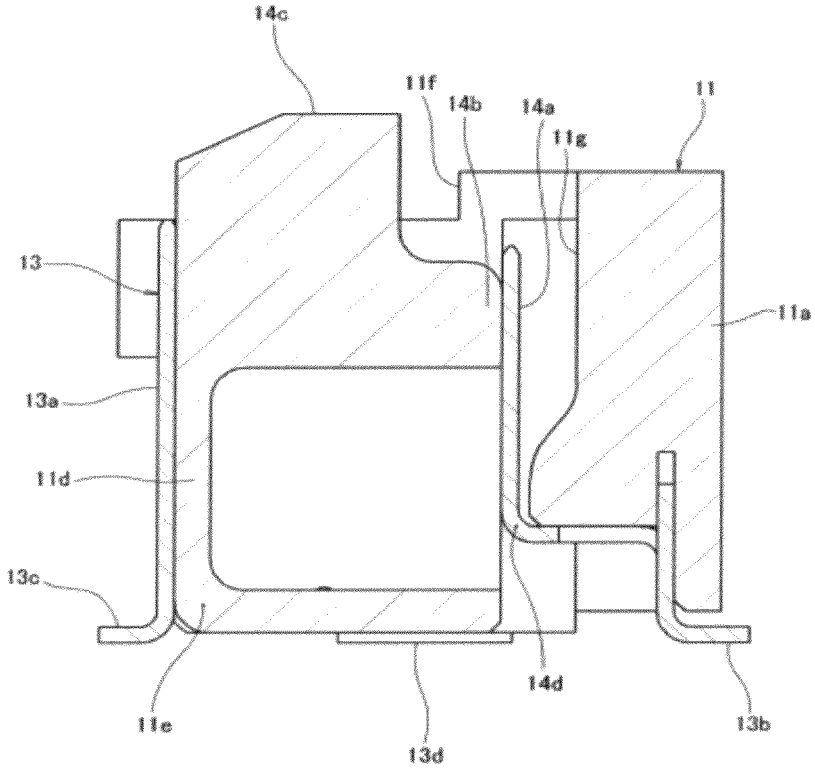
FIG. 6 is a cross-sectional explanatory view taken along line VI-VI in FIG. 3.
Figure 7:
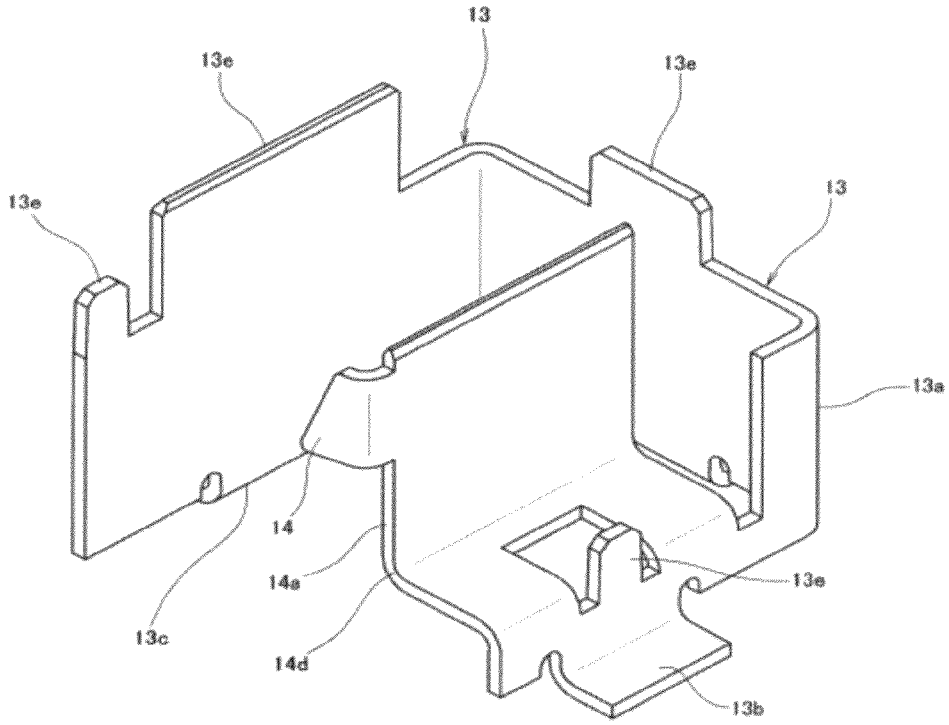
FIG. 7 is a perspective appearance explanatory view showing a structure of a plan view side of a holddown used in the electrical connection shown in FIG. 1 to FIG. 6.
Figure 8:
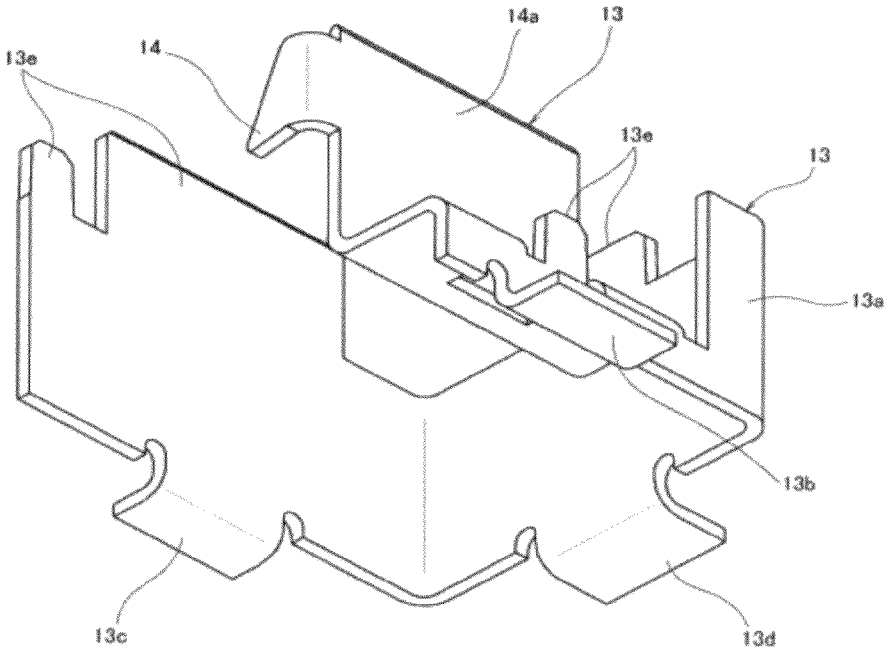
FIG. 8 is a perspective appearance explanatory view of a bottom view side of the holddown shown in FIG. 7.

Embodiments of the present invention applied to a plug connector will be described below in detail with reference to the drawings.

An electrical connector 1 according to an embodiment of the present invention shown in FIGS. 1 to 11 is an electrical connector mounted on a circuit board (not shown) constituting a portion of an electronic circuit of an electrical product, and the electrical connector 1 includes a connector main body portion 11 disposed so as to rise from a surface of the circuit board disposed substantially horizontally. The connector main body portion 11 is provided with an insulating housing 11*a* extending in an elongated shape along the surface of the circuit board.

In what follows, explanation is made under the assumption that the surface of the circuit board (not shown) extends horizontally, a direction in which the connector main body portion 11 rises from the surface of the circuit board is defined as "upward direction", and the opposite direction thereof is defined as "downward direction". Further, an extending direction of the elongated insulating housing 11*a* constituting the connector main body portion 11 is defined as "connector longitudinal direction", and a direction perpendicular to both the "connector longitudinal direction" and the "upward and downward directions" is defined as "front-back direction".

In a top face that is an end of rising of the insulating housing 11*a* described above positioned on a rising side thereof, an insertion opening portion 11*c* into which a signal transmission medium PB, such as a flexible flat cable (FFC) or a flexible printed circuit board (FPC) described later, is inserted is formed in a narrow slit shape in the connector longitudinal direction. A terminal portion of the signal transmission medium PB is inserted into the electrical connector 1, more specifically, into a hollow interior of the insulating housing 11*a*, from the insertion opening portion 11*c* by disposing the signal transmission medium PB above the insertion opening portion 11*c* so as to be substantially perpendicular to the surface of the circuit board (not shown) with the terminal portion facing downward, and moving the terminal portion of the signal transmission medium PB downward.

According to such an upper side insertion structure for the signal transmission medium PB, when the signal transmission medium PB is inserted into the insertion opening portion 11*c* of the connector main body portion 11, a positional relationship between the insertion opening portion 11*c* and the signal transmission medium PB is easily viewed from above, and therefore insertion operation of the signal transmission medium PB can be performed easily and precisely, and the signal transmission medium PB is maintained in a good inserted state.

Further, a large number of conductive contacts (conductive terminals) 12, 12, . . . are attached to the insulating housing 11*a* at predetermined pitch intervals in the connector longitudinal direction of the insulating housing 11*a* in a multipolar shape. Each of these conductive contacts 12 has a contact-point portion 12*a* which comes into contact with the terminal portion of the signal transmission medium PB, such as a flexible flat cable (FFC) or a flexible printed circuit board (FPC), inserted in the electrical connector 1 in the above-described manner. Each conductive contact 12 is extended downward from the contact-point portion 12*a*, bent at a substantially right angle in a lower end portion that comes into contact with the circuit board (not shown), and protruded backward (rightward in FIG. 4). A connection terminal portion 12*b* provided at a backward-extended end portion of each conductive contact 12 is soldered to a conductive path formed on the circuit board (not shown) described above.

Further, a pair of holddowns 13, 13 obtained by shaping a thin-plate-shaped metal member by bending is provided on both end portions of the insulating housing 11*a* described above in the connector longitudinal direction. Each of these holddowns 13 has a base frame plate 13*a* that surrounds each end portion of the insulating housing 11*a* in the connector longitudinal direction externally in a substantially C shape in a planar view, as shown particularly in FIGS. 7 and 8. A lower end edge portion of the base frame plate 13*a* is provided with a pair of board connection leg portions 13*b*, 13*c* protruded in both directions of the front and back directions, and also provided with a single board connection leg portion 13*d* protruded outward in the connector longitudinal direction.

Each of these board connection leg portions 13*b*, 13*c*, 13*d* is composed of a plate-shaped member protruded outward from the lower end edge portion of the base frame plate 13*a* described above, and is formed such that a distal end portion thereof extends substantially horizontally. These extended distal end portions of the board connection leg portions 13*b*, 13*c*, 13*d* are soldered to conductive paths (not shown) formed on the surface of the circuit board (not shown) described above.

Further, of these three board connection leg portions 13*b*, 13*c*, 13*d*, the pair of board connection leg portions 13*b*, 13*c* is formed so as to protrude in the opposite front or back directions from each other, and these paired board connection leg portions 13*b*, 13*c* are disposed to align substantially with each other in the front and back directions. A positional relationship between the board connection leg portions 13*b*, 13*c* will be described later in detail as an element constituting the present invention.

On the other hand, above the above-described three board connection leg portions 13*b*, 13*c*, 13*d*, a plurality of plate-shaped engaging portions 13*e* is formed so as to protrude upward individually, and the holddown 13 is fixed to the insulating housing 11*a* by press-fitting each of these engaging portions 13*e* into the insulating housing 11*a*.

Figure 12:
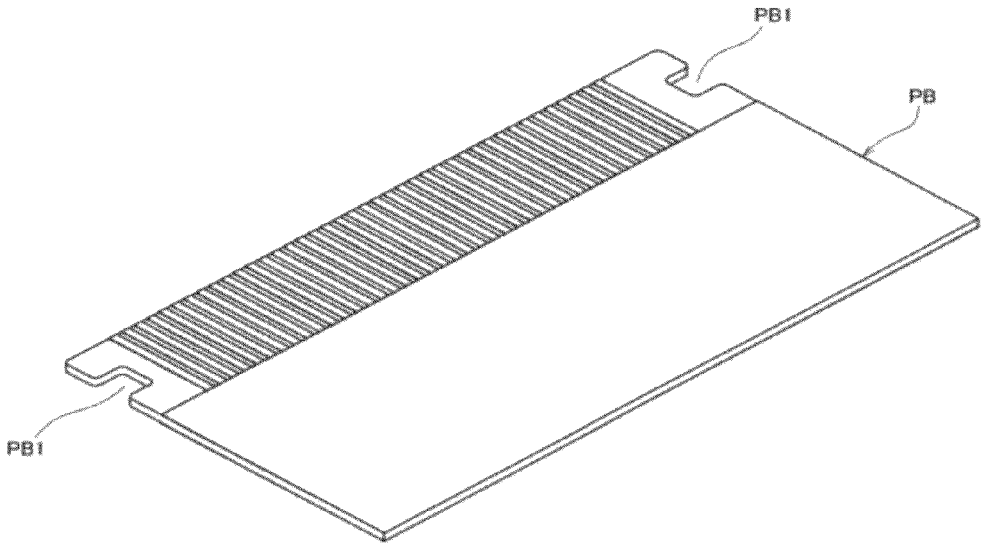
FIG. 12 is a perspective appearance explanatory view showing one example of a signal transmission medium to be inserted into the electrical connector shown in FIG. 1 to FIG. 11.
Figure 13:
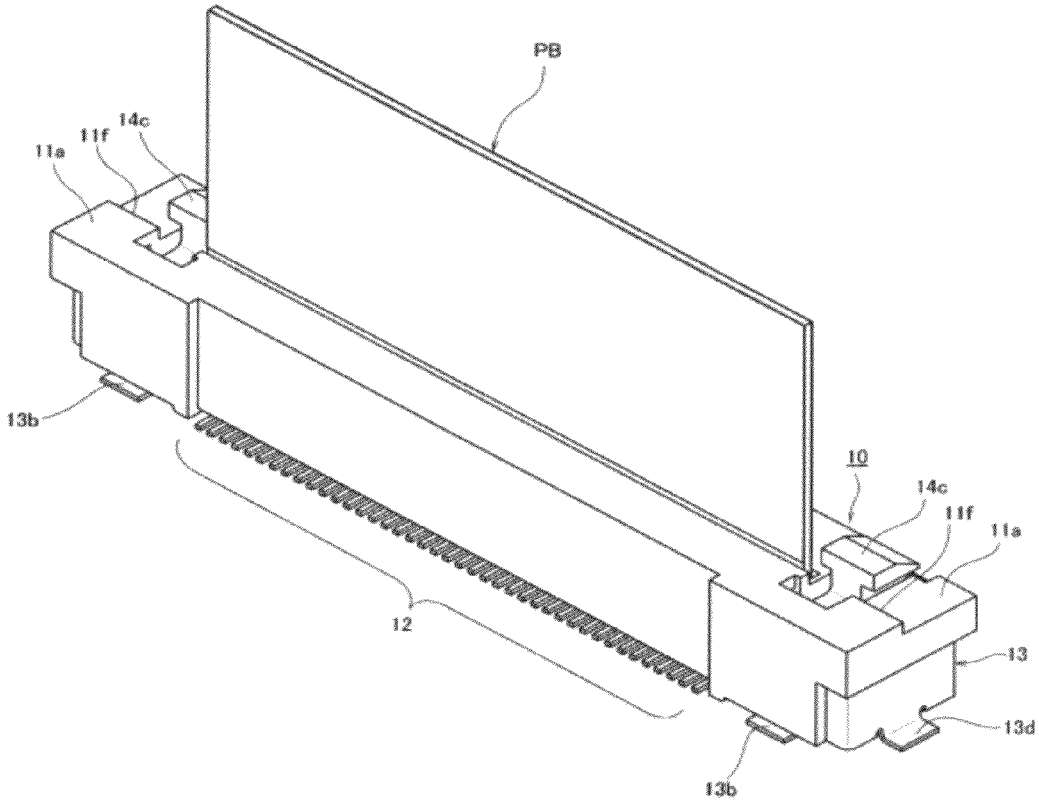
FIG. 13 is a perspective appearance explanatory view showing a state where the signal transmission medium shown in FIG. 12 has been inserted into the electrical connector shown in FIG. 1 to FIG. 11.

Next, positioning portions PB1 composed of a notch-shaped recess are formed in both end edge portions of the terminal portion of the signal transmission medium PB inserted into the connector main body portion 11 in the above-described manner in a widthwise direction thereof, as shown particularly in FIG. 12. The positioning portions PB1 provided in the signal transmission medium PB are configured to be engaged with locking portions 14 provided in the electrical connector 1 when the signal transmission medium PB is inserted in the electrical connector 1, so that the signal transmission medium PB is held in an inserted state by engagement with the locking portions 14.

At this time, the locking portion 14 is formed so as to be integral with the board connection leg portion 13*b* of the holddown 13 described above. That is, in continuity with an inside root portion of the board connection leg portion 13*b* protruded backward from the connector main body portion 11, a locking arm member 14*a* composed of a swinging member extended upward in a cantilever shape is integrally provided so as to be elastically displaced. On a top edge portion of the locking arm member 14*a* composed of the cantilever-shaped swinging member, that is, on a portion of the locking arm member 14*a* positioned on a swinging side thereof, the locking portion 14 composed of a hook-shaped member is integrally formed. At this time, the locking arm member 14*a* is bent upward at a substantially right angle from the inside root portion of the board connection leg portion 13*b*, then bent substantially horizontally and extended frontward, and extended upward from a distal end portion of the horizontally extended portion toward the insertion opening portion 11*c* described above.

On the other hand, the locking portion 14 is formed of a plate-shaped member bent so as to protrude frontward from a side end edge of an upper end portion of the locking arm member 14*a*, a lower end portion of the locking portion 14 is formed in a hook shape, and an inclined guide side inclined upward and backward from the hook-shaped portion is formed.

Figure 14:
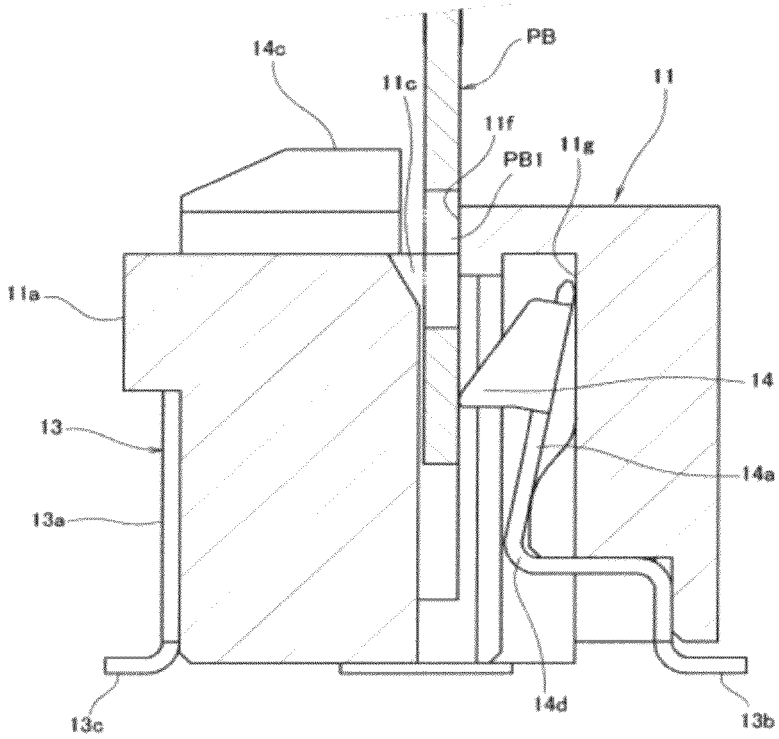
FIG. 14 is a cross-sectional explanatory view showing a course of insertion of the signal transmission medium shown in FIG. 12 into the electrical connector shown in FIG. 1 to FIG. 11 and corresponding to FIG. 5.
Figure 15:
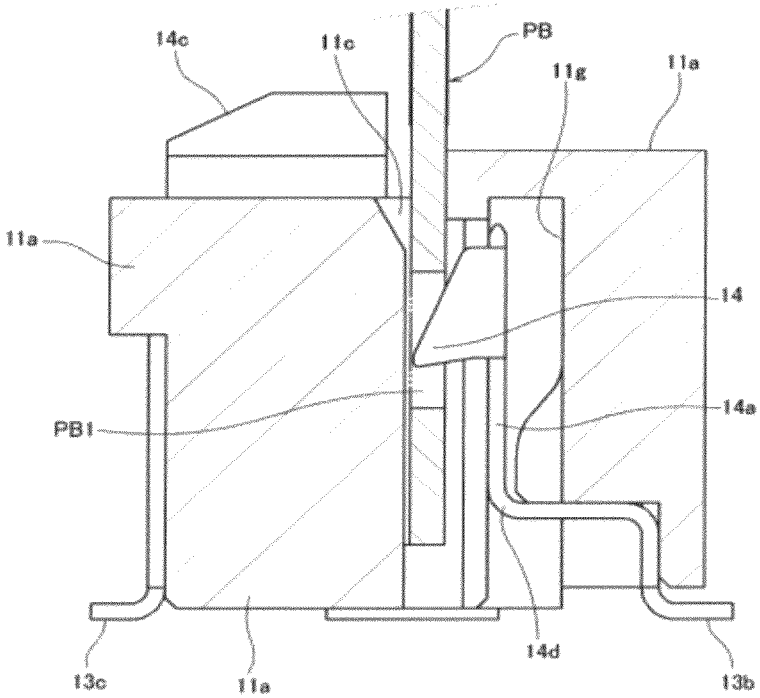
FIG. 15 is a cross-sectional explanatory view showing a holding state where the insertion of the signal transmission medium has been completed from the state shown in FIG. 14 and corresponding to FIG. 5.

As shown in FIG. 14, when the signal transmission medium PB is inserted into the connector main body portion 11, the terminal portion of the signal transmission medium PB abuts on the inclined guide side of the locking portion 14, and the locking arm member 14*a* described above is elastically displaced so as to be inclined backward from a substantially-upright position ordinary located in front on a swinging fulcrum 14*d* formed at a lower bent portion of the locking arm member 14*a*. When the terminal portion of the signal transmission medium PB is pushed further downward, the hook-shaped portion of the locking portion 14 is swung by an elastic restoring force of the locking arm member 14*a* so as to fall into the positioning portion (notch-shaped recess) PB1 of the signal transmission medium PB, as shown in FIG. 15. Thereby, the locking portion 14 is caused to engage the positioning portion PB1 of the signal transmission medium PB so that holding state of the signal transmission medium PB is maintained.

According to such a configuration, the state of the locking portion 14 holding the signal transmission medium PB is well maintained by an elastic restoring action of the locking arm member 14*a* composed of the swinging member.

Figure 11:
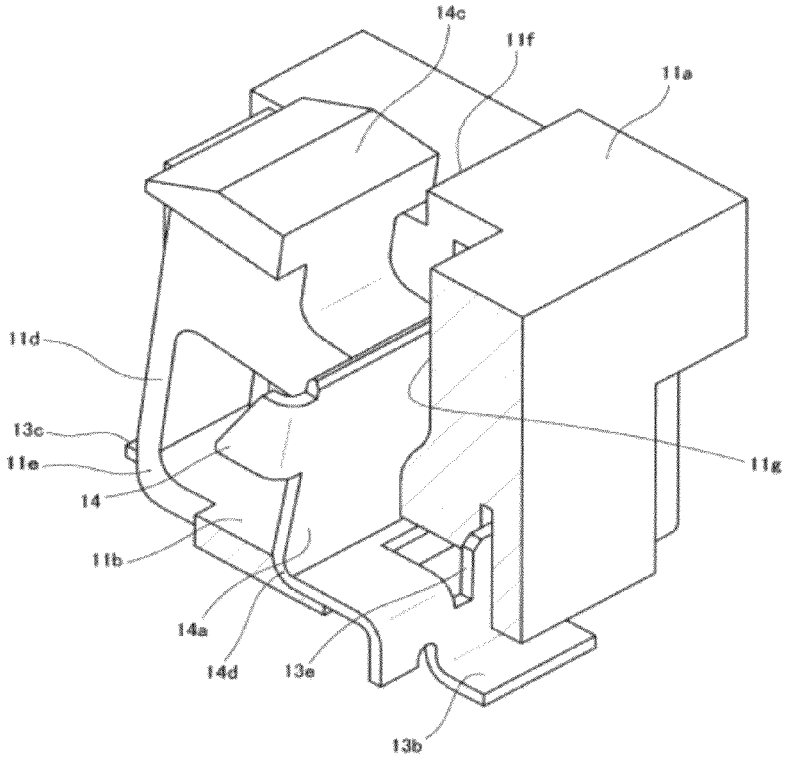
FIG. 11 is a perspective explanatory view showing a positional relationship between the locking portion and the unlocking portion in the operated state shown in FIG. 10 where the unlocking portion has been swung in the unlocking direction.
Figure 16:
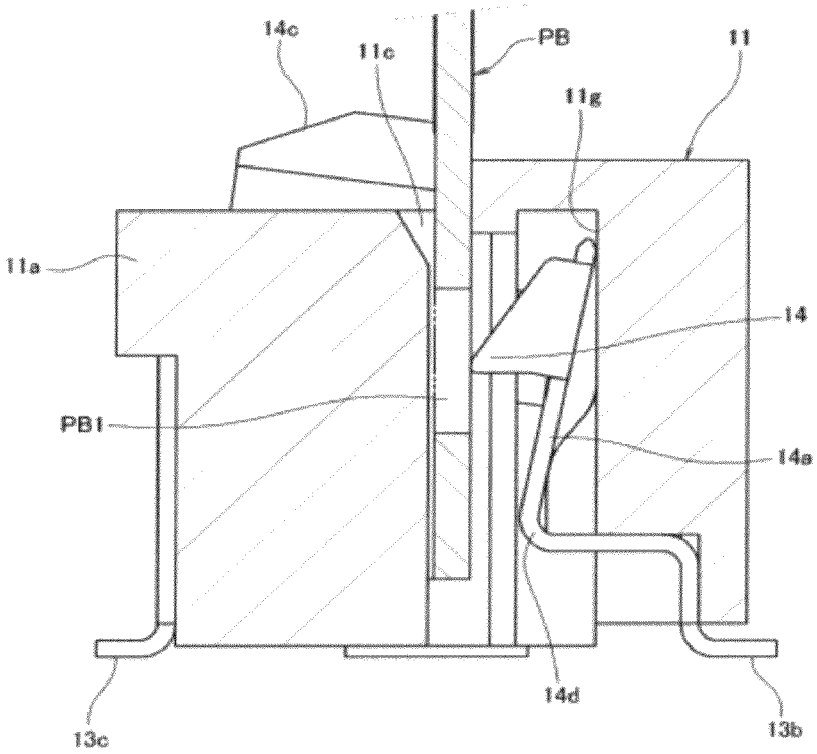
FIG. 16 is a cross-sectional explanatory view showing a state where an unlocking-operation portion has been swung from the holding state shown in FIG. 15 in an unlocking direction and corresponding to FIG. 5.

On the other hand, when unlocking operation is performed as described later, the locking arm member 14*a* is swung so as to be inclined backward against its own elastic force, as shown in FIGS. 16 and 11, and at this time the whole of the locking portion 14 including the hook-shaped portion described above is caused to release the positioning portion PB1 of the signal transmission medium PB.

More specifically, the insulating housing 11*a* constituting the connector main body portion 11 described above is integrally provided with an unlocking portion 14*b* that causes the locking portion 14 to release the signal transmission medium PB, and an unlocking-operation portion 14*c* for moving the unlocking portion 14*b*. These unlocking portion 14*b* and unlocking-operation portion 14*c* are provided on an upper portion of an unlocking arm member 11*d* extended in a cantilever shape from a front end edge of a bottom face portion 11*b* constituting the insulating housing 11*a* so as to be elastically displaced. The unlocking arm member 11*d* composed of a portion of the insulating housing 11*a* is formed of a similar swinging member to that of the locking arm member 14*a* formed so as to be integral with the holddown 13 made of a metal member described above, and both these swinging members 11*d*, 14*a* are disposed at each end in the connector longitudinal direction so as to be face each other in the front and back directions.

The unlocking portion 14*b* described above is provided at an upper end side of the unlocking arm member 11*d*, that is, at a position of a distal portion of a swinging portion of the unlocking arm member 11*d* corresponding to the locking portion 14. That is, the unlocking portion 14*b* has a protruded shape protruding backward from a location approximately equal in height to the locking portion 14, and disposed so as to abut on or separate from the locking arm member 14*a* in a site near the locking portion 14 on a front face of the locking arm member 14*a*, more specifically, in a location on the front face positioned slightly outside the locking portion 14 in the connector longitudinal direction. Further, an arrangement relationship is established in which a projecting end of the unlocking portion 14*b* is caused to abut on the front face of the locking arm member 11*a* from the front when the unlocking arm member 11*d* is elastically displaced so as to incline backward by an unlocking operation, as described later (see FIGS. 16 and 11). By continuing the unlocking operation further from their abutting state, the locking arm member 14*a* together with the unlocking arm member 11*d* is elastically displaced so as to incline backward.

On the other hand, when the unlocking arm member 11*d* is put into an unlocked state, that is, in an unoperated stated, after the unlocking operation is completed, the unlocking arm member 11*d* is swung by its own elastic restoring force so as to return to an original substantially-upright state, and at this time the locking arm member 14*a* also returns to the original substantially-upright state by its own elastic restoring force.

Further, the unlocking-operation portion 14*c* is disposed slightly above the unlocking portion 14*b* described above, and located in an uppermost end portion of the unlocking arm member 11*d*. The unlocking operation portion 14*c* is formed in a knob shape, and configured such that, when an operation force from an operator is applied backward to the unlocking-operation portion 14*c* according to an unlocking operation, the unlocking arm member 11*d* is elastically displaced backward in a swinging manner on a swinging fulcrum 11*e* which is a connection portion with the bottom face portion 11*b* so that the unlocking portion 14*b* is caused to abut on or separate from the locking arm member 14*a*, as described above.

Figure 9:
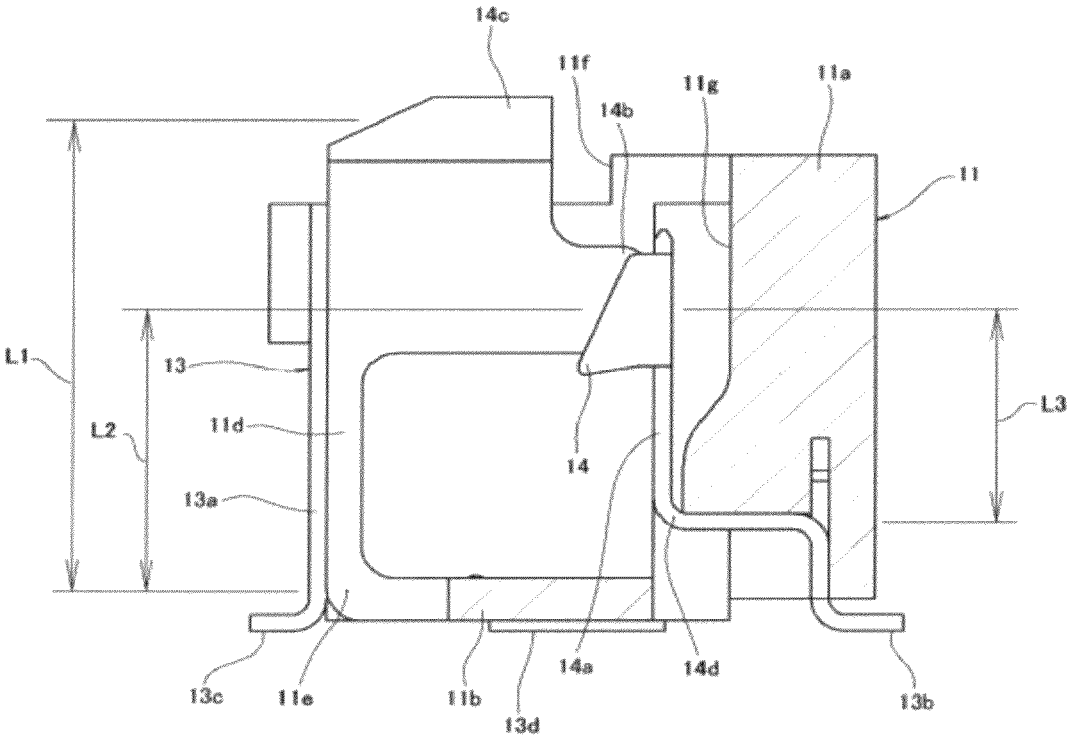
FIG. 9 is a cross-sectional explanatory view showing a positional relationship between a locking portion and an unlocking portion in an ordinary state (non-operated state)
Figure 10:
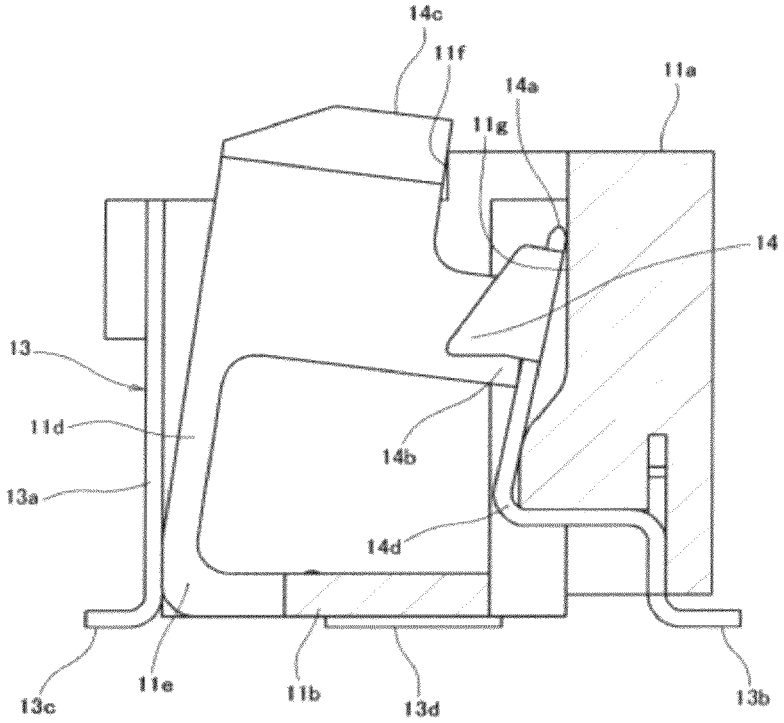
FIG. 10 is a cross-sectional explanatory view showing a state (operated state) where the unlocking portion has been swung from the ordinary state (non-operated state) shown in FIG. 9 in an unlocking direction.

At this time, as shown in FIG. 9, a swinging radius L1 from the swinging fulcrum 11*e* of the unlocking arm member 11*d* described above to the unlocking-operation portion 14*c* is set larger than a swinging radius L2 from the swinging fulcrum 11*e* of the unlocking arm member 11*d* to the unlocking portion 14*b* (L1>L2). Further, the swinging radius L2 to the unlocking portion 14*b* is set larger than a swinging radius L3 from the swinging fulcrum 14*d* of the locking arm member 14*a* described above to the locking portion 14 (L2>L3).

Thus, first of all, in this embodiment, since the locking arm member 14*a* is extended from the swinging fulcrum 14*d* on a lower side located near the board connection leg portion 13*b* to the locking portion 14 on the side of a swinging distal end, so as to have a relatively-elongated swinging radius, an unlocking action on the locking portion 14 holding the signal transmission medium PB is easily performed by relatively small operation force. Note that it is possible to reduce the unlocking-operation force further by changing the shape of the locking arm member 14*a* and setting the position of the swinging fulcrum 14*d* lower than that in this embodiment.

Further, at this time, since the locking arm member 14*a* including the locking portion 14 is formed so as to be integral with the board connection leg portion 13*b*, the locking portion 14 is manufactured efficiently along with the board connection leg portion 13*b*, so that increase in the number of parts can be suppressed, and reduction in manufacturing cost can be achieved efficiently.

Furthermore, since the distal portion of the swinging portion of the locking arm member 14*a* is pushed by the unlocking portion 14*b* when an unlocking operation is performed in order to cause the locking portion 14 to release the signal transmission medium PB, an acting force required for unlocking operation is reduced, so that easy unlocking operation becomes possible. Moreover, since an operation force required for elastic displacement of the unlocking arm member 11*d* is smaller than an elastically-displacing force of the locking portion 14, an operation force required for unlocking is reduced, so that the unlocking operation is easily performed.

Besides, according to this embodiment, when the unlocking arm member 11*d* is formed so as to be integral with the insulating housing 11*a* constituting the connector main body portion 11, the unlocking arm member 11*d* and the unlocking portion 14*b* are formed simultaneously with formation of the insulating housing 11*a*, so that increase in the number of parts can be suppressed, and reduction in manufacturing cost can be achieved effectively.

In addition, since the unlocking-operation force applied to the locking portion 14 is stably received by the board connection leg portion 13*b* fixed to the printed circuit board via the locking arm member 14*a*, strength against the unlocking operation is improved, so that even repeating the operation of unlocking the locking portion 14 many times has less effect on the mounted state of the connector main body portion or the like, and accordingly electrical connection is stably maintained for a long period. Particularly in this embodiment, since the board connection leg portions 13*b*, 13*c* are disposed to be aligned with each other in the front-back direction so as to protrude in the opposite directions from each other in an extending direction of the swinging radius relating to the swinging fulcrum 14*d* of the locking arm member 14*a* described above, a swinging operation force on the unlocking arm member 11*d* is received directly by the pair of board connection leg portions 13*b*, 13*c* at the unlocking-operation time, deformation or the like of the connector main body portion 11 is prevented and accordingly the connected state of the signal transmission medium PB is held well. Further, not only the unlocking portion 14*b* and the board connection leg portions 13*b*, 13*c* are disposed to be aligned with one another in the front-back direction, but the engaging portion 13*e* located near the board connection leg portion 13*b* is also disposed to be aligned with these portions in the front-back direction. This makes it possible to stably receive the elastically-displacing force of the locking arm member 14*a* by the engaging portion 13*e*, so that improvement in strength against the unlocking operation can be achieved.

On the other hand, on both the end portions of the insulating housing 11*a* described above in the connector longitudinal direction, unlocking-operation restricting portions 11*f* are provided so as to face the unlocking-operation portions 14*c*. Each of these unlocking-operation restricting portions 11*f* is formed of a step portion rising from an upper face of the insulating housing 11*a* behind the unlocking-operation portion 14*c*, and is disposed such that a rising end face constituting the step portion of the unlocking-operation restricting portion 11*f* is opposed to a back-end face of the unlocking-operation portion 14*c* in an unoperated state. A maximum movable position of the unlocking-operation portion 14*c* is defined by causing the unlocking-operation portion 14*c* to abut on the unlocking-operation restricting portion 11*f* after releasing the locking portion 14 from the signal transmission medium PB by swinging the unlocking-operation portion 14*c* backward from the unoperated state.

Furthermore, locking-movement restricting portions 11*g* abutting on the locking portions 14 released from the signal transmission medium PB are provided in both the end portion of the insulating housing 11*a* in the connector longitudinal direction. The locking-movement restricting portion 11*g* is formed of a vertical wall-shaped portion disposed behind the unlocking portion 14*b*, and a maximum movable position of the locking portion 14 is restricted by abutting of an upper end portion of the locking arm member 14*a* on a wall face of the vertical wall-shaped portion of the locking-movement restricting portion 11*g* after the locking portion 14 is released from the signal transmission medium PB by elastic backward displacement of the locking arm member 14*a* due to an abutting force of the unlocking portion 14*b*. Strictly speaking, the maximum movable position of the locking portion 14 is restricted by the above-described abutting between the unlocking-operation portion 14*c* and the unlocking-operation restricting portion 11*f*, and the abutting between the upper end portion of the locking arm member 14*a* and the locking-movement restricting portion 11*g* serves a supplementary role of restriction of the maximum movable position of the locking portion 14.

According to such a configuration, since movement amounts of the unlocking-operation portion 14*c* and the locking portion 14 are restricted so as not to be excessive by the unlocking-operation restricting portion 11*f* and the locking-movement restricting portion 11*g* at the time of the unlocking operation, deformation, breakage, or the like of each portion is avoided.

The invention which have been made by the present inventor(s) has been specifically described above based on the embodiment, but it goes without saying that the present invention is not limited to the embodiment described above, but can be variously modified without departing from the scope of the present invention.

Each embodiment described above is not limited to an electrical connector of a vertical insertion type, and can also be applied to an electrical connector of a horizontal insertion type in a similar manner.

Besides, an electrical connector according to the present invention is not limited to one which performs such connection as the embodiment described above, but the present invention can be also applied in a similar manner to various electrical connectors which electrically connect boards to each other, or a cable and a board to each other.

INDUSTRIAL APPLICABILITY

As describe above, the present invention is widely applicable to various electrical connectors used for electrical devices.

What is claimed is:

1. An electrical connector that connects a signal transmission medium electrically to a circuit board, comprising:

board connection leg portions soldered to the circuit board;

a connector main body portion mounted so as to rise from a surface of the circuit board via the board connection leg portions;

an insertion opening portion provided in a rising end portion of the connector main body portion; and a locking portion that is engaged with a portion of the signal transmission medium inserted into the connector main body portion from the insertion opening portion to hold an inserted state of the signal transmission medium, wherein the locking portion is provided on a portion of an elastically-displaceable locking arm member formed so as to be integral with the board connection leg portion, the locking arm member is formed of a swinging member extending in a cantilever shape from the board connection leg portion toward the insertion opening portion, and the locking portion is disposed at a distal end portion of the locking arm member positioned on a swinging side thereof Wherein the connector main body portion is provided with an unlocking portion that releases the locking portion from the signal transmission medium, the unlocking portion is provided on a portion of an unlocking arm member formed of a swinging member extending in a cantilever shape so as to be elastically displaceable, and the unlocking portion is disposed so as to abut on or separate from a distal portion of a swinging portion of the locking arm, which is positioned near the locking portion.

2. The electrical connector according to claim 1, wherein the unlocking arm member is formed so as to be integral with an insulating housing constituting the connector main body portion.

3. The electrical connector according to claim 1, wherein the board connection leg portions are provided in pair so as to protrude in an extending direction of a swinging radius of the locking arm member and in the opposite directions from each other from the connector main body portion.

4. The electrical connector according to claim 1, wherein the insulating housing is provided with a locking-movement restricting portion that defines a maximum movable position of the locking portion by abutting on the locking portion caused to release from the signal transmission medium.

5. The electrical connector according to claim 1, wherein a swinging radius L2 of the unlocking arm member is set larger than a swinging radius L3 of the locking arm member (L2>L3).

6. The electrical connector according to claim 1, wherein the unlocking arm member is provided with an unlocking-operation portion that swings the unlocking arm member, and the unlocking-operation portion is disposed outside the unlocking portion in a swinging radius direction.

7. The electrical connector according to claim 6, wherein the insulating housing is provided with an unlocking-operation restricting portion that defines a maximum movable position of the unlocking-operation portion by abutting on the unlocking-operation portion.

* * * * *